US006050280A

United States Patent [19]

Jeske

[11] Patent Number: 6,050,280

[45] Date of Patent: Apr. 18, 2000

[54] SPORTS SHADE

[76] Inventor: Stewart Patrick Jeske, 11000 N. Grand, Kansas City, Mo. 64155

[21] Appl. No.: 09/092,745

[22] Filed: Jun. 6, 1998

[51] Int. Cl.[7] ..... E04H 15/58

[52] U.S. Cl. ..... 135/117; 135/115; 135/119

[58] Field of Search ..... 52/3, 73, 74; 135/90, 135/117, 115, 903, 88.12, 88.11, 88.1, 118, 119

[56] References Cited

U.S. PATENT DOCUMENTS

| | | | |
|---|---|---|---|
| 3,906,969 | 9/1975 | Myers . | |
| 4,068,673 | 1/1978 | Bernardi . | |
| 4,719,954 | 1/1988 | Curtis et al. . | |
| 4,733,683 | 3/1988 | Pozzi . | |
| 5,174,073 | 12/1992 | Sabo . | |
| 5,246,052 | 9/1993 | Homan | 160/65 |
| 5,280,687 | 1/1994 | Boiteau . | |
| 5,381,814 | 1/1995 | Brandon . | |
| 5,400,813 | 3/1995 | Swan, Jr. . | |
| 5,437,298 | 8/1995 | Lin . | |
| 5,531,239 | 7/1996 | Hannah | 135/88.1 |
| 5,558,145 | 9/1996 | Baka . | |
| 5,860,440 | 1/1999 | Murray | 135/88.12 |

*Primary Examiner*—Beth Stephan
*Attorney, Agent, or Firm*—Wm. Bruce Day

[57] ABSTRACT

A portable awning producing shade adjacent to ball field fences and dugouts and similar situations comprised of a retractable awning wound around a roller tube, a housing for the awning and roller tube, telescoping legs, guy lines for lateral stability and a handle attached to the housing. The free end of the awning protrudes through an elongated slot in the housing and is attached by snap hooks to a fence. The other end of the awning is attached to the roller tube which is mounted inside of the housing. The housing is vertically supported by the telescoping legs and stabilized by the guy lines attached to the ground. The telescoping legs are attached to the housing by hinges so that the legs may fold adjacent to the housing for stowing. The housing has a handle and restraining straps attached to it for portability and includes storage areas at the ends of the housing provided for the guy lines and stakes. The restraining straps hold the legs parallel to the housing while stowed.

16 Claims, 7 Drawing Sheets

SPORTS SHADE

BACKGROUND OF THE INVENTION

1. Field of the Invention

This invention relates to sunshade awnings, specifically to such awnings which are portable and are used in conjunction with a fence or other means of support to produce shade.

2. Description of Related Art

There are many situations where shade is desirable for both baseball and softball participants and spectators to prevent heat exhaustion and dehydration. Some ball field dugouts are permanently covered, but the vast majority are not.

Inventors have designed many types of permanent and portable awnings to attach to buildings, recreational vehicles, vans and cars. Disadvantages of such awnings is that they are specifically designed to be attached to a vehicle or building, are cumbersome to assemble and difficult to carry by a single person.

U.S. Pat. No. 5,280,687 to Boiteau (1994), U.S. Pat. No. 4,733,683 to Pozzi (1985) and U.S. Pat. No. 4,719,954 to Curtis, Juracek and Scherer (1986) are typical of the type of awnings designed to be permanently attached to recreational vehicles. These types of awnings have the obvious disadvantage of permanent type attachments to sides of vehicles. Furthermore, if detached, they would be exceedingly bulky and difficult to carry.

U.S. Pat. No. 3,906,969 to Myers (1975), U.S. Pat. No. 5,381,814 to Brandon (1995) and U.S. Pat. No. 5,558,145 to Baka (1996) all indicate retractable awnings to be temporarily mounted to luggage racks or roof surfaces of vehicles. Although these awnings are somewhat portable, these too would be difficult to carry by hand and attach to a ball field fence. U.S. Pat. No. 5,400,813 to Swan (1995) indicates a simplified awning attached at one end to the vehicle and supported by poles and guying lines at the other end. While this type of awning could be carried to a ball field, the time required to unpack and assemble and then to repack after a game is a deterrence to its use. In addition, one of the pieces to this assembly could be lost rendering it useless.

Other sunshade devises such as canopies and umbrellas have been used to produce shade at beaches, campsites, etc. These sunshade devises are also not suitable for shade at ball field dugouts due to their cumbersome nature to transport, set up and take down. Although umbrellas are easy to use and transport, they afford little shade and are difficult to fix to the ground during winds.

U.S. Pat. No. 5,437,298 to Lin (1995) shows a sunshade arrangement consisting of a material stretched between a roller and header bars supported by four legs. While this arrangement is shown to be portable, it includes four legs where only two are needed if the canopy is partially supported by the fence. In addition, the poles are intended to be pushed into the ground and would be ineffective if the ground directly below the poles were concrete or asphalt.

U.S. Pat. No. 4,068,673 to Bernardi (1978) depicts a canister awning supported by a single leg. The awning material is supported by two telescoping arms from the single leg. An awning of this type which relies on the single leg to be fixed into the ground is not usable when the ground is hard or impenetrable below the single leg and is prone to instability during winds.

U.S. Pat. No. 5,174,073 to Sabo (1992) indicates a portable shielding system consisting of a retractable screening material in a housing. This invention, designed to screen objects and equipment in the field, requires the housing to be supported by the ground or the object to be screened. Detachable legs (or spacers) are specified only to support the screening material away from the housing and the equipment. If the legs were used to support the housing, the structure would be unstable. In addition, rings are specified at the free end of the screening material for fastening to the ground with stakes and could not directly attach to a fence. Thus this shielding system would be unsuitable to cover a ball field dugout.

SUMMARY OF PRESENT INVENTION

The present invention provides a temporary and portable awning producing shade adjacent to ball field fences and dugouts and similar situations which will be evident from the description. The awning is economical to manufacturer, self contained, quick and simple to deploy and tear down, stable during winds and is portable by a single person. The basic invention incorporates a retractable awning stored inside of a housing. The housing has a handle for portability and extendible fold out legs to support the housing. In the stored position the legs are parallel with the housing and held to it by fastened straps attached to the body of the housing. At each end of the housing are storage pockets for guy lines and spikes.

Ball players and coaches typically have very little time to take occupancy of a dugout usually due to a previous game. This necessitates a rapid set up of any device used for shade. The invented sports shade awning meets this need and is set up with minimal steps. This awning is attachable to a fence by snap hooks and extended by pulling on the housing handle away from the fence. At an extended position, the awning is preferably locked from retraction. The legs are then rotated down and extended to a preferred height. The guy lines with spikes attached are withdrawn from the housing ends and fastened to the ground for stability. Taking down the awning is also simple and quick.

In one embodiment the housing has transparent plastic envelopes attached with openings that may be reclosed. The envelopes are used for displaying the team name and/or the team sponsor.

LIST OF REFERENCE NUMERALS IN DRAWINGS

| | | | |
|---|---|---|---|
| 10 | awning material | 22 | flanges |
| 11 | snap hooks | 23 | stopper |
| 12 | grommet | 24 | end piece |
| 13 | fence | 25 | holding notch |
| 14 | roller tube | 26 | guy attachment hole |
| 15 | housing | 27 | strap extension |
| 16 | handle | 28 | stakes |
| 17 | restraining straps | 29 | second fence |
| 18 | telescoping legs | 30 | display envelope |
| 19 | guy lines | 31 | name sheet |
| 20 | handle straps | 32 | boots |
| 21 | bolt | | |

Detailed description of the invention—FIGS. 1 to 7

Figure 1:
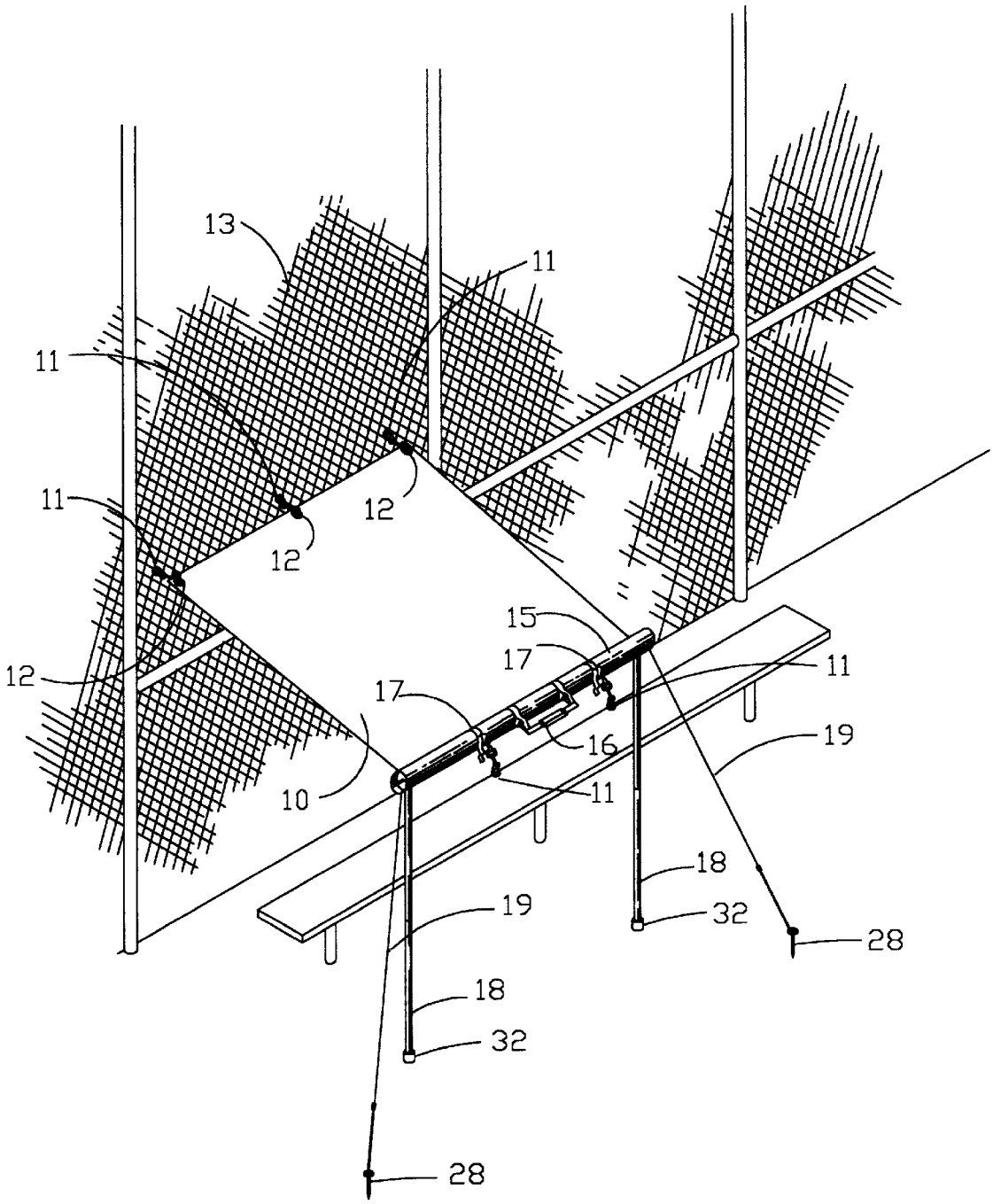
FIG. 1 is a perspective view of one embodiment of the present invention in the erected position.

A typical embodiment of the portable awning of the present invention is shown in an erected position in FIG. 1. An awning material 10 consist of flexible sheet material of cloth or plastic. At the free end of awning material 10 snap hooks 11 are fastened through grommets 12 and attached to a shown fence 13. The second end of the awning material 10 is fastened by conventional means a roller tube 14 (shown in FIG. 2) located inside a housing 15.

A spring system which applies a torque is included in the make of roller tube 14. The torque causes roller tube 14 to turn in the direction for wrapping awning material 10 around the roller tube. Such torsion based roller systems are well-known to persons having ordinary skills in the art and is not specifically disclosed herein.

Figure 4:
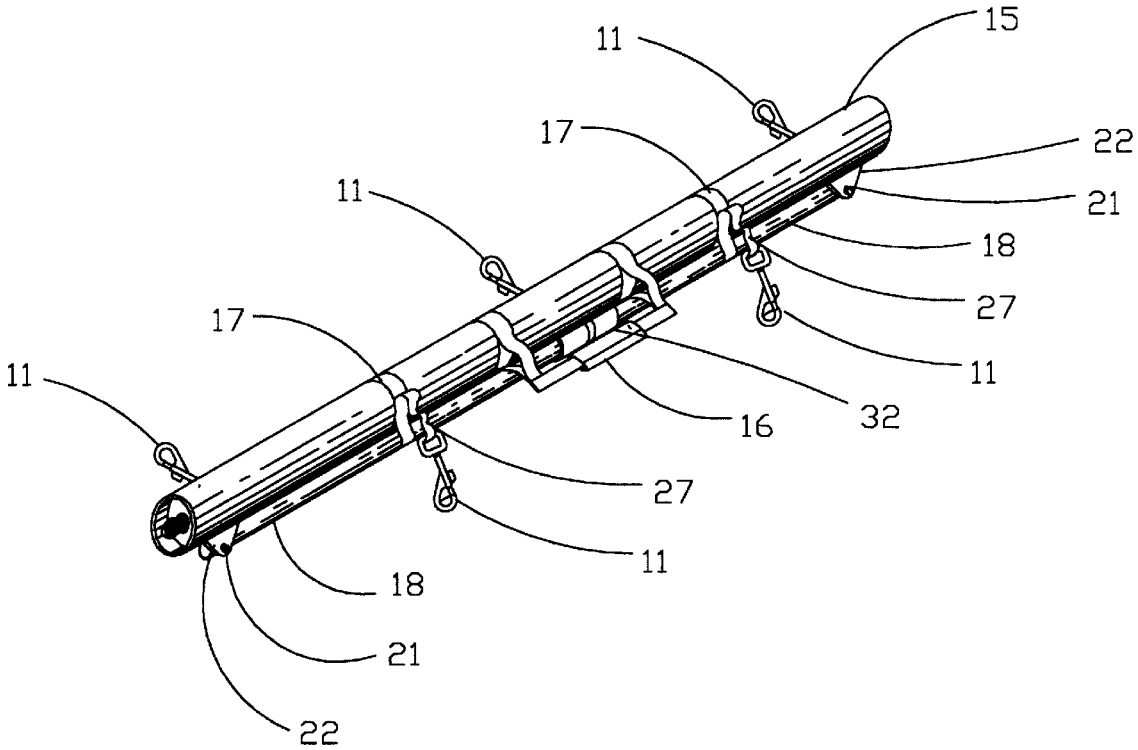
FIG. 4 is a perspective view of the invention in the stowed position.

The exterior of housing 15 has a handle 16 attached at mid length either by mechanical means or adhesion. Handle 16 is preferably made of flexible canvas material, but may alternately be made of a rigid material such as plastic or wood. Also attached to housing 15 are restraining straps 17 spaced equidistant from the center. Restraining straps 17 consist of strips of flexible material preferably canvas which serve to hold telescoping legs 18 parallel to housing 15 when stowed as shown in FIG. 4. The composition of housing 15 may be of plastic, metal or composite material and is manufactured in portable sections six to ten feet long.

As shown in FIG. 1 each end of housing 15 is supported by telescoping legs 18 and guy lines 19 for stability. Telescoping legs 18 are preferably constructed of hollow aluminum sections and have conventional means (not shown) for height adjustment of the telescoping legs. The bottom portion of each telescoping leg 18 is covered by a plastic molded boot 32. Each guy line 19 consist of a thin diameter nylon rope with conventional tension adjustment means. Guy lines 19 are connected at the top to the ends of the housing 15 and at the bottom to stakes 28. Each stake 28 is attached to the ground by driving force.

Figure 2:
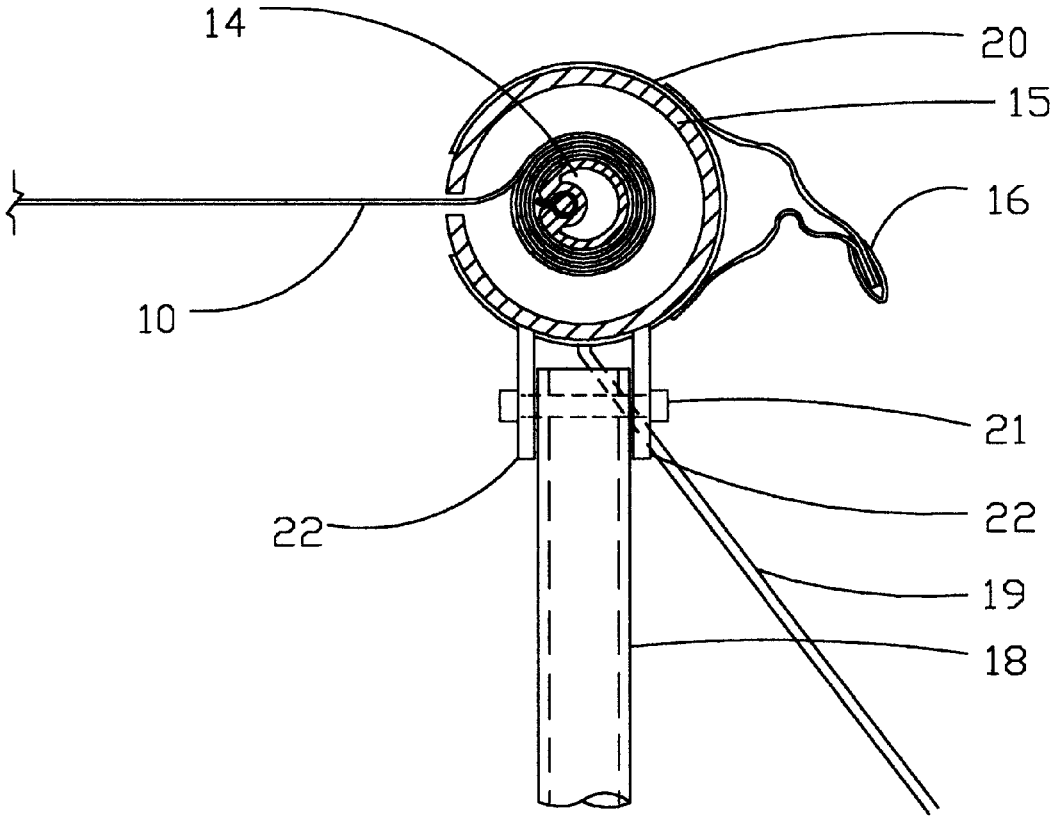
FIG. 2 is a sectional view of the awning in FIG. 1.

FIG. 2 is a section cut through housing 15 in the erected position shown in FIG. 1. A horizontal slot in the side wall of housing 15 allows awning material 10 to be extended. Awning material 10 is shown attached to the roller bar 14 in the center of housing 15 as previously stated.

The handle 16, shown in FIG. 2, is located at 180 degrees from the slot in housing 15 for the purpose of pulling on the housing and extending awning material 10. Handle 16 is shown attached to handle straps 20 extending around the perimeter of housing 15 short of the slot. Handle straps 20 are preferably constructed from strong canvas material and are attached to housing 15 by adhesion or mechanical means.

Telescoping legs 18 are also shown in FIG. 2 supporting housing 15. The telescoping legs 18 are attached by a through bolt 21 to flanges 22. Flanges 22 are attached to housing 15 by adhesion or welding.

Figure 3:
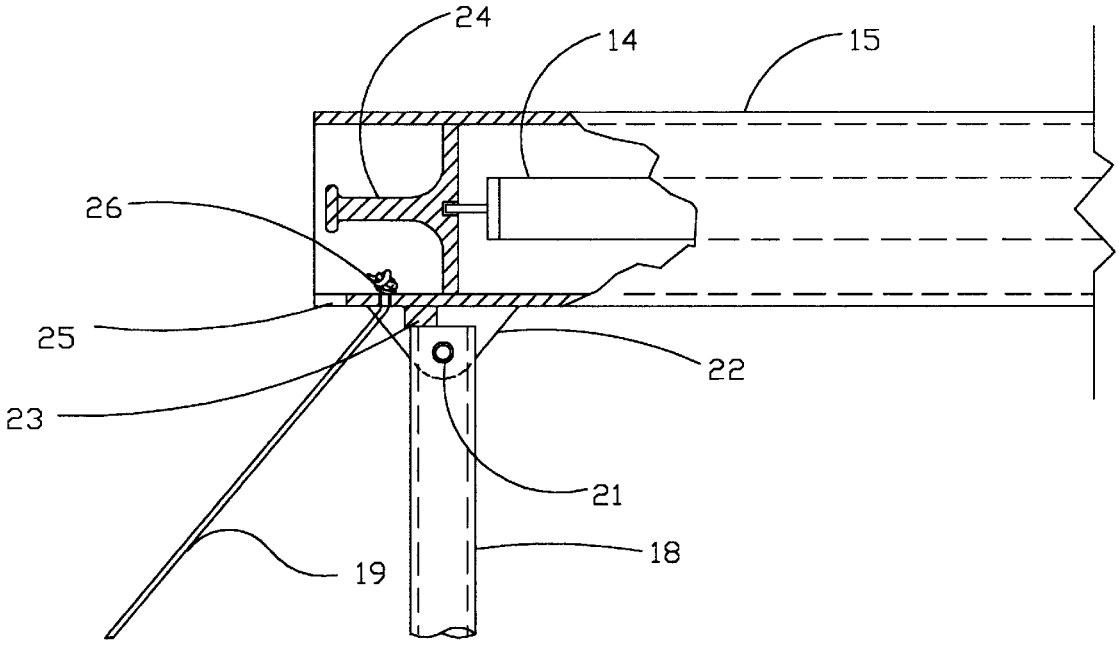
FIG. 3 is a cut-away elevation of one end of the awning in FIG. 1

FIG. 3 is an elevation view of the end of housing 15 in the erected position shown in FIG. 1. The outside of housing 15 is cut away revealing roller tube 14 fixed in place by an end piece 24. The end piece 24 is molded of durable plastic or composite material and includes a notch for holding roller tube 14. The end piece 24 is formed with a spindle which may be used to wrap guy line 19 around for stowing. Two end pieces 24 are attached to the inside of each end of housing 15 by adhesive or mechanical means.

Also introduced in FIG. 3 are a holding notch 25, a guy attachment hole 26 and a stopper 23. Both holding notch 25 and guy attachment hole 26 are cut from each end of housing 15. The holding notch 25 serves to hold guy line 19 in place while stowing by being slightly smaller in width than the diameter of guy line 19. The guy attachment hole 26 is used to secure guy line 19 to housing 15. The stopper 23 is similar to a rubberized door stopper and prevents over rotation of the telescoping legs 18. The stopper 23 is attached by mechanical means to housing 15 at each leg attachment point.

FIG. 4 shows a preferred embodiment of the awning in the stowed position. Awning material 10 which is not illustrated in the figure has been retracted in to housing 15. The snap hooks 11 remain on the exterior of housing 15 as they are too large to fit through the slot in the housing. Restraining straps 17 are fastened around housing 15 and telescoping legs 18. Strap extensions 27 are attached to restraining straps 17 and have snap hooks 11 attached to their ends. The strap extensions 27 are preferably made of the same material as the restraining straps 17. The snap hooks 11 with strap extensions 27 may be attached to fences, ball bags, etc.

Figure 5:
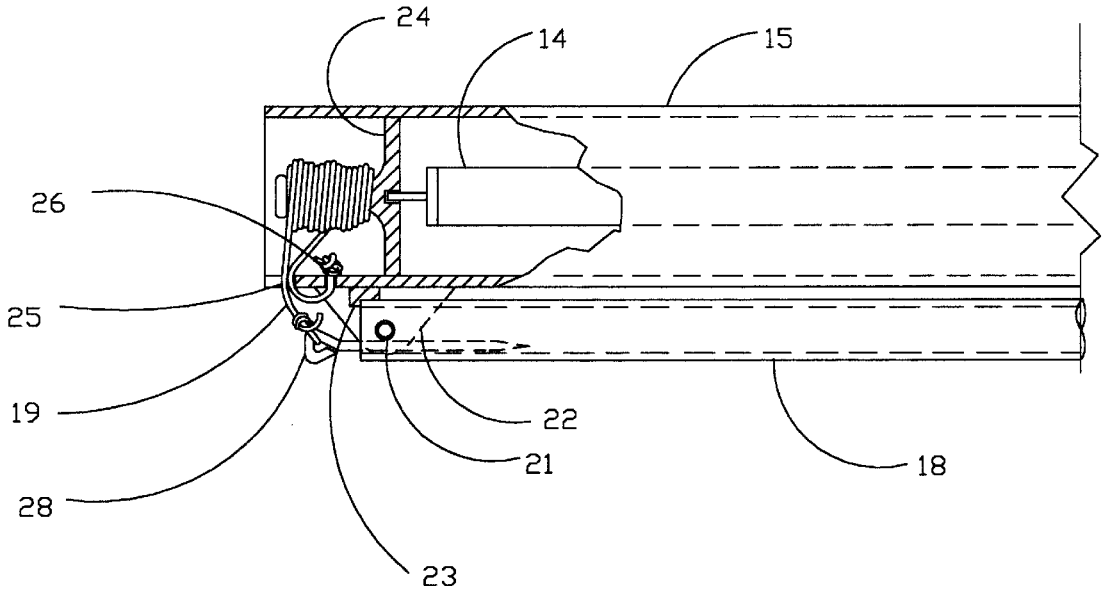
FIG. 5 is a cut-away elevation of one end of the awning in the stowed position shown in FIG. 4.

FIG. 5 is a sectional view cut at the end of housing 15 shown in the stowed position of FIG. 4. The stake 28 is shown stowed in the top end of telescoping leg 18. The guy line 19 is wound around the spindle of end piece 24 and held in position by holding notch 25.

Figure 6:
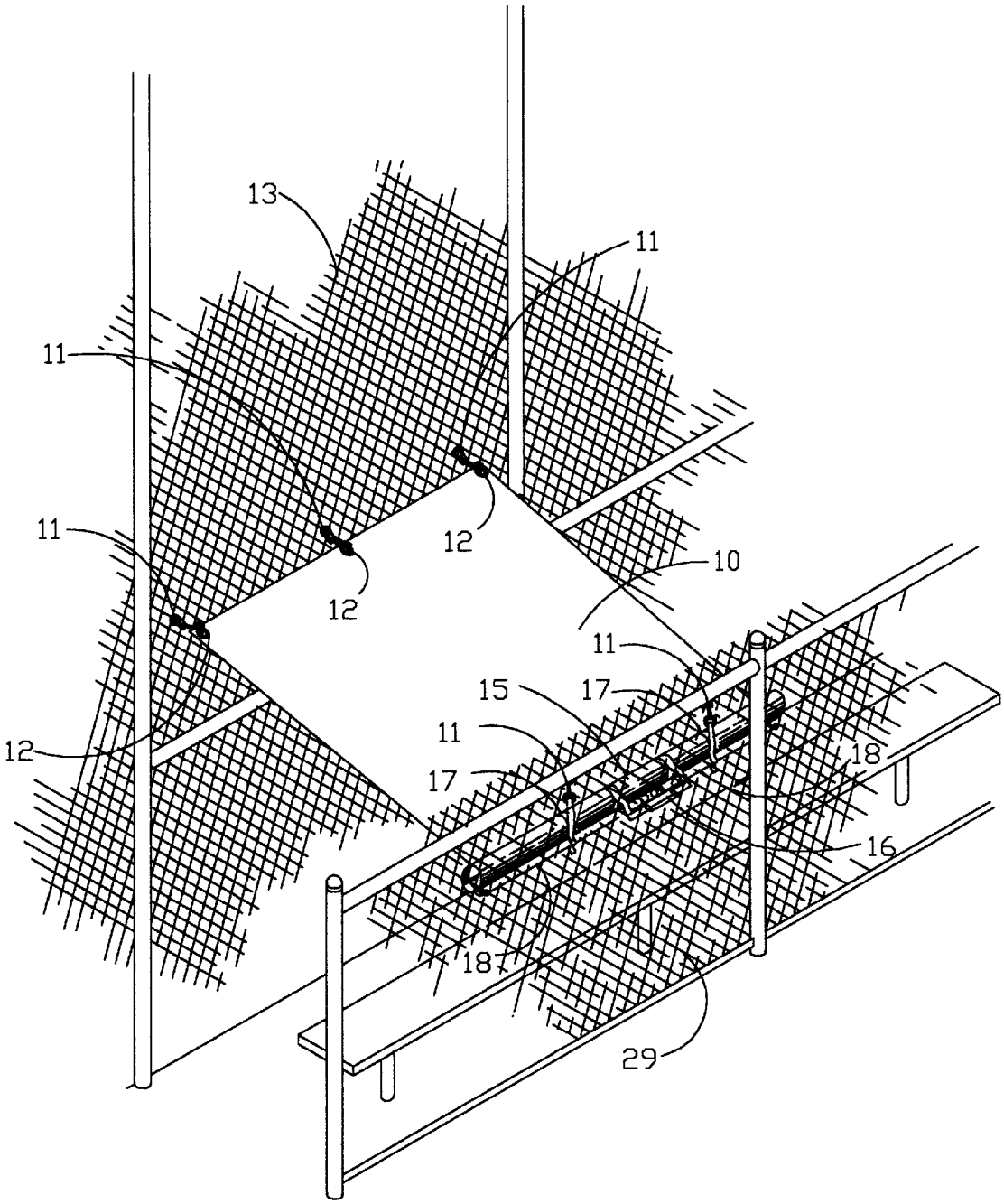
FIG. 6 is a perspective view illustrating the use of the invention between two fences.

FIG. 6 shows the use of the portable awning when two fences are present. The awning material 10 is attached to fence 13 and extended as previously described. The snap hooks 11 attached to strap extensions 27 are used to attach to a second fence 29 and support housing 15.

Figure 7:
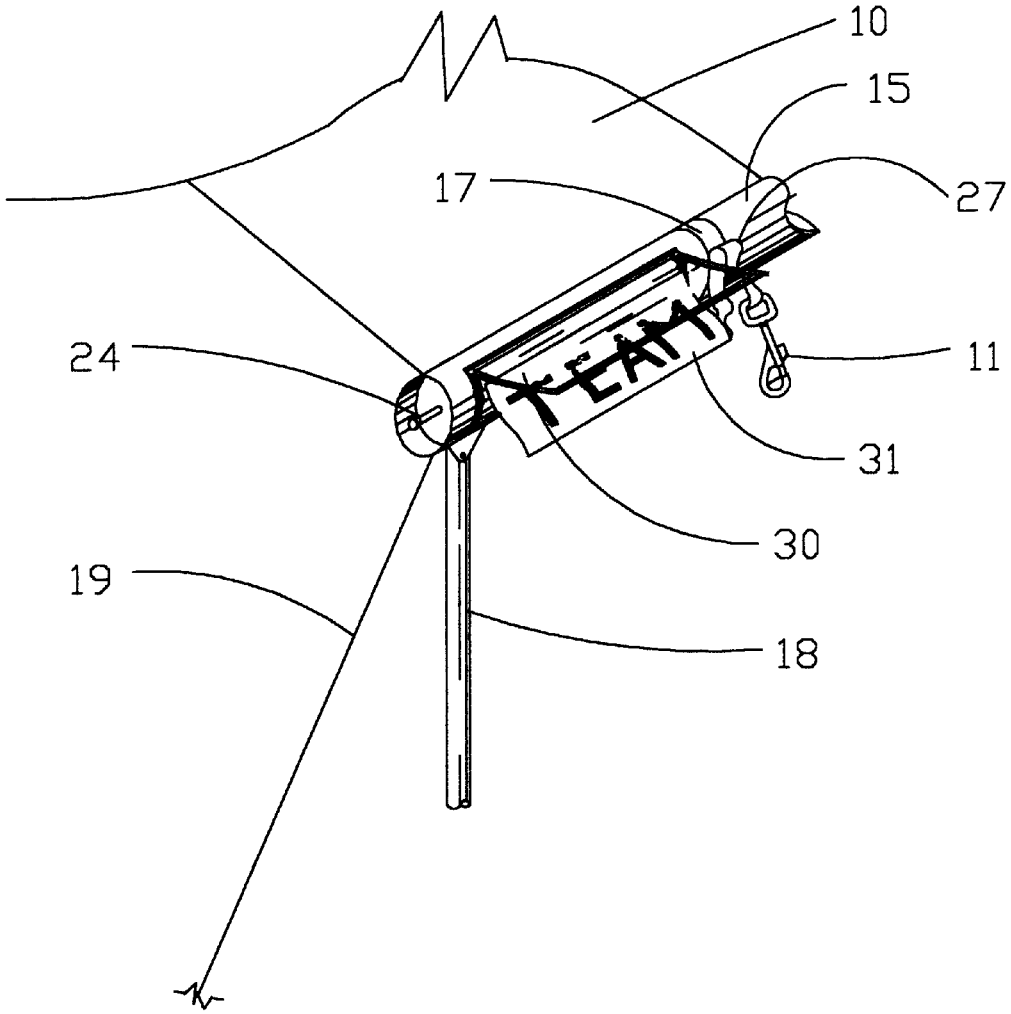
FIG. 7 is a perspective detail of the flexible transparent envelope attached to the awning housing for displaying the team name or sponsor.

FIG. 7 indicates an additional preferred embodiment of the invention with a display envelope 30 attached to housing 15. The display envelope 30 consists of flexible transparent plastic with edges that preferably fasten to housing 15 by Velcro strips; Velcro is a trademark by S. and W. Framing Supplies, Inc. of New York and/or Velcro Corp. of New York and relates to hook-and-loop fasteners. However, many fastening methods are possible including zipper locks, snaps, etc. The envelope 30 may be opened to insert a name sheet 31 and closed to display the team name, sponsor, etc. appearing on the name sheet.

Operation—FIGS. 1, 2, 3, 4, 5

For installation, snap hooks 11 are attached to fence 13 at a desired height as shown in FIG. 1. The restraining straps 17 are then unfastened and awning material 10 extended by pulling on handle 16 in a direction away from fence 13. At full extension of awning material 10, roller tube 14 (FIG. 2) is automatically locked keeping the awning material from retracting.

The stake 28 shown in the stowed position in FIG. 5 is removed from the top ends of each telescoping leg 18. The telescoping legs 18 are then folded out, extended in a vertical direction and locked at the desired height.

Referring to FIG. 1 and FIG. 3, guy lines 19 at each end of housing 15 are unwound from stowed positions, shown in FIG. 5, to a desired position diagonal of telescoping legs 18. The stakes 28 are driven into the ground and guy lines 19 are adjusted to provide the necessary tension for stability.

To remove the portable awning, the steps described above are reversed culminating with the awning in the stowed position shown in FIG. 4.

Summary

Accordingly, the reader will see that the portable sports awning of this invention meets a need currently not addressed by other inventions. Ball players become very hot on warm sunny days and desire shade. However, limited set-up time, portability and stability issues prevent them from utilizing other forms of shade producing devices. The invention described meets this need with the following advantages:

It requires minimal set-up time with a minimum amount of steps.

It is designed to be hand carried by one person and may be attached to ball bags.

It is self contained and does not have free parts that could get lost.

It is stable during winds, relying on the fence for partial support.

It provides a means for displaying the team name and sponsor.

It may be used between two fences in the case of a fenced in dugout.

Although the description above contains many specificity's, these should not be construed as limiting the scope of the invention, but as merely providing illustrations of some of the presently preferred embodiments of this invention. For example the housing could be made an oval cylinder, triangular cylinder, etc. In addition, other obvious uses of the invention may incorporate attachment to vehicles, trees or any other types of support.

Thus the scope of the invention should be determined by the claims and their legal equivalents, rather than by the examples given.

What is claimed is:

1. A portable sports awning assembly comprising:

an elongated housing having a side with an elongated opening;

an elongated roller mounted inside said housing, said roller including torsion means for providing a retraction force when rotationally displaced from original orientation;

a sheet of retractable awning material having an inner edge secured to said roller for winding and unwinding upon and an outer edge extending through said elongated opening and said outer edge including fastening means for attaching to a fence;

a plurality of support members of equal length for supporting said housing;

a hinge connection attaching said support members to said housing allowing for rotation of said support members parallel with said housing for the purpose of stowing;

a plurality of guy lines with tension adjustment means, said guy lines attached at first ends to said housing and attached at second ends to stakes, whereby said stakes may be driven into the ground tensioning said guy lines for lateral stability of the awning assembly;

a plurality of end pieces for said housing, wherein said end pieces are inserted into said housing a distance of approximately 100 millimeters and fixed to said housing and to ends of said roller, retaining a vacancy at said ends of said housing to create a storage area for said guy lines.

2. The portable awning assembly of claim 1, further including a handle secured to said housing.

3. The portable awning assembly of claim 1, further including a plurality of restraining straps with fastening means attached to said housing, said straps being of sufficient length to extend around the circumference of said housing and said support members while said support members are in a stowed position adjacent to said housing, whereby fastening the ends of said straps, said support members are secured adjacent to said housing.

4. The portable awning assembly of claim 1, wherein a length of said support members is adjustable.

5. The portable awning assembly of claim 1, further including a plurality of fastening devices secured to exterior sides of said housing, whereby said fastening devices maybe attached to a supporting fence.

6. The portable awning assembly of claim 1, wherein said end pieces include a spindle protruding into said storage area about which said guy lines may be coiled for storage.

7. The awning assembly of claim 1, further including a plurality of holding notches, wherein each notch is comprised of a slot cut parallel to said housing at each end of said housing, wherein said notches are cut a width slightly smaller than the diameter of said guy lines for the purpose of holding said guy lines in place while the awning assembly is transported.

8. A portable sports awning assembly comprising:

an elongated housing having a side with an elongated opening;

an elongated roller mounted inside said housing, said roller including torsion means for providing a retraction force when rotationally displaced from original orientation;

a sheet of retractable awning material having an inner edge secured to said roller for winding and unwinding upon and an outer edge extending through said elongated opening and said outer edge including fastening means for attaching to fence;

a plurality of support members of equal length for supporting said housing;

a hinge connection attaching said support members to said housing allowing for rotation of said support members parallel with said housing for the purpose of stowing;

a plurality of guy lines with tension adjustment means, said guy lines attached at their first ends to said housing and attached at their second ends to a matching number of stakes, whereby said stakes may be driven into the ground tensioning said guy lines for lateral stability of the awning assembly;

a plurality of end pieces for said housing, wherein said end pieces are inserted into said housing a distance of approximately 100 millimeters and fixed to said housing and to ends of said roller, whereby a vacancy at said ends of said housing creates a storage area for said guy lines;

a flexible transparent envelope fixed to a portion of said housing, wherein said envelope includes means for opening and resealing, whereby an identifying sheet of material may be inserted into said envelope and viewed from the exterior.

9. The portable awning assembly of claim 8, further including a handle secured to said housing.

10. The portable awning assembly of claim 8, further including a plurality of restraining straps with fastening means attached to said housing, said straps being of sufficient length to extend around the circumference of said housing and said support members while said support members are in a stowed position adjacent to said housing, whereby fastening the ends of said straps, said support members are secured adjacent to said housing.

11. The portable awning assembly of claim 8, wherein a length of said support members is adjustable.

12. The portable awning assembly of claim 8, further including a plurality of fastening devices secured to exterior sides of said housing, whereby said fastening devices may be attached to a supporting fence.

13. The portable awning assembly of claim 8, wherein said end pieces include a spindle protruding into said storage area about which said guy lines may be coiled for storage.

14. The awning assembly of claim 8, further including a plurality of holding notches, wherein each notch is comprised of a slot cut parallel to said housing at each end of said housing, and wherein said notches are cut a width slightly smaller than the diameter of said guy lines for the purpose of holding said guy lines in place while the awning assembly is transported.

15. A portable sports awning comprising:

a) an elongate housing having a longitudinal open slot, a roller mounted within said housing and an awning furled on said roller and extensible and retractable relative to said housing through said slot;

b) spaced upright support legs for elevating said housing above a ground surface;

c) fasteners associated with an outer edge of said awning for easily detachably connecting said awning when extended to an upright structure displaced laterally from said housing;

d) a stabilizer extending from said housing to said ground surface in a direction opposite to the extension of said awning from said housing, whereby said awning is selectively positionable over a ground surface.

16. The portable sports awning set forth in claim 14, herein said support legs are telescoping and have a swingable connection with said housing for retracting and folding said legs longitudinally parallel against said housing for storage.

* * * * *